US005959714A

United States Patent [19]

Chou

[11] Patent Number: 5,959,714

[45] Date of Patent: Sep. 28, 1999

[54] SWIMMING GOGGLES FOR IMPROVED SAFETY AND COMFORT

[76] Inventor: Terry Chou, No. 12, Hsin Ho Herng Road, Tainan City, Taiwan

[21] Appl. No.: 09/192,425

[22] Filed: Nov. 16, 1998

[51] Int. Cl.[6] ..... G02C 1/00

[52] U.S. Cl. ..... 351/43; 351/41

[58] Field of Search ..... 351/43, 41; 2/426, 2/431, 440

[56] References Cited

U.S. PATENT DOCUMENTS 2,309,832 2/1943 Dockson et al. ..... 351/43

*Primary Examiner*—Hung Xuan Dang

*Attorney, Agent, or Firm*—Charles E. Baxley, Esq.

[57] ABSTRACT

A pair of swimming goggles includes two lenses, two pads, a bridge, and a strap. The lenses are made of transparent material and each includes a recessed section for receiving an eye portion of a user. Each lens further includes an inner end, a streamlined outer end, and a flange formed on an inner side thereof. The bridge interconnects the inner ends of the lenses. The pads are substantially ring-like and made of plastic material. Each pad includes a receiving section for receiving an associated flange and a contact section for providing a close, comfortable contact with the user's eye socket. Each pad further includes an outer end with an opening through which one of the ends of the strap is wound. The strap connection is thus improved to provide a larger visual angle, increase safety, and provide a comfortable and reliable contact with the user's head.

1 Claim, 6 Drawing Sheets

SWIMMING GOGGLES FOR IMPROVED SAFETY AND COMFORT

BACKGROUND OF THE INVENTION

1. Field of the Invention

The present invention relates to a pair of swimming goggles with improved strap connection to provide a larger visual angle, increase safety, and provide a comfortable, reliable contact with the user's head.

2. Description of the Related Art

FIG. 5 illustrates a pair of conventional swimming goggles that includes two lenses 1' made of rigid transparent material, a bridge 3' for interconnecting inner ends of the lenses 1', and a strap 4' for interconnecting outer ends 12' of the lenses 1'. The outer end 12' of each lens 1' includes a strap engaging section 15' for engaging with the strap 4', and a clamper 41' is provided to allow length adjustment of the strap 4'. Two outer pads 2' are provided and each includes a receiving section 21' for receiving a flange 13' formed on an inner side of an associated lens 1' and a contact section 22' that provides a close, comfortable contact with the eye socket of the user. Nevertheless, as shown in FIG. 6, the visual angle "a" of such pair of swimming goggles is limited by the strap engaging sections 15'. In addition, the outer end 12' must have a certain thickness to include the strap engaging section 15' such that the outer end 12' has a distal protruded portion "b" that causes an increase in the swimming resistance. In addition, the strap engaging section 15' of each lens 1' and the associated pad 2' still has a clearance therebetween such that the strap 4' has a section that is not in close contact with the user's head (see reference numeral "c"). More specifically, the pair of swimming goggles is not reliably worn on the user's head. The present invention is intended to provide an improved design to solve these problems.

SUMMARY OF THE INVENTION

A pair of swimming goggles in accordance with the present invention comprises two lenses, two pads, a bridge, and a strap. The lenses are made of rigid transparent material and each includes a recessed section for receiving an eye portion of a user. Each lens further includes an inner end, a streamlined outer end, and a flange formed on an inner side thereof. The bridge interconnects the inner ends of the lenses.

The pads are substantially ring-like and made of plastic material. Each pad includes a receiving section for receiving an associated flange and a contact section for providing a close, comfortable contact with the user's eye socket. Each pad further includes an outer end with an opening through which one of the ends of the strap is wound.

By such an arrangement, the strap connection is improved to provide a larger visual angle, increase safety, and provide a comfortable and reliable contact with the user's head.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
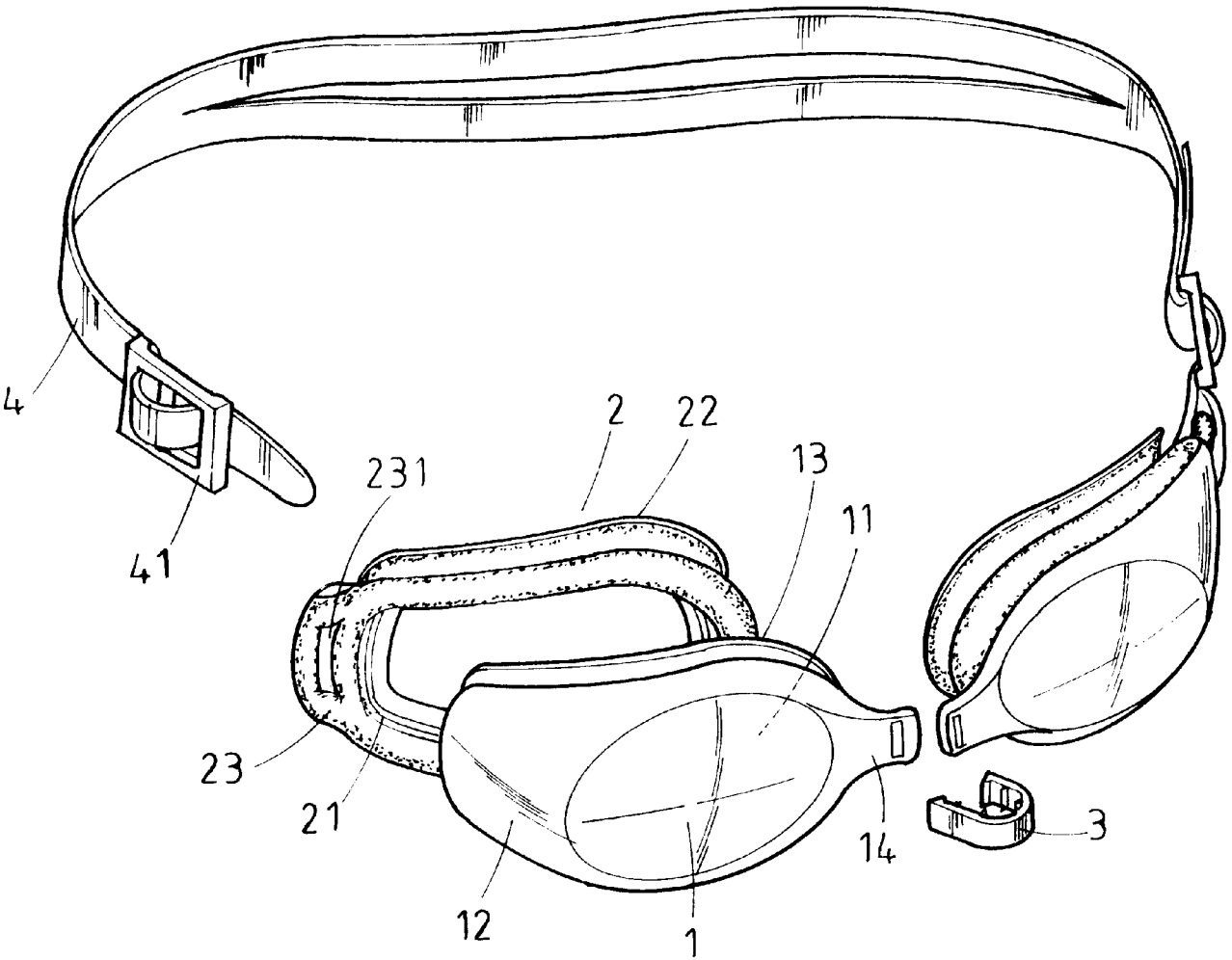
FIG. 1 is an exploded perspective view of a pair of swimming goggles in accordance with the present invention.
Figure 2:
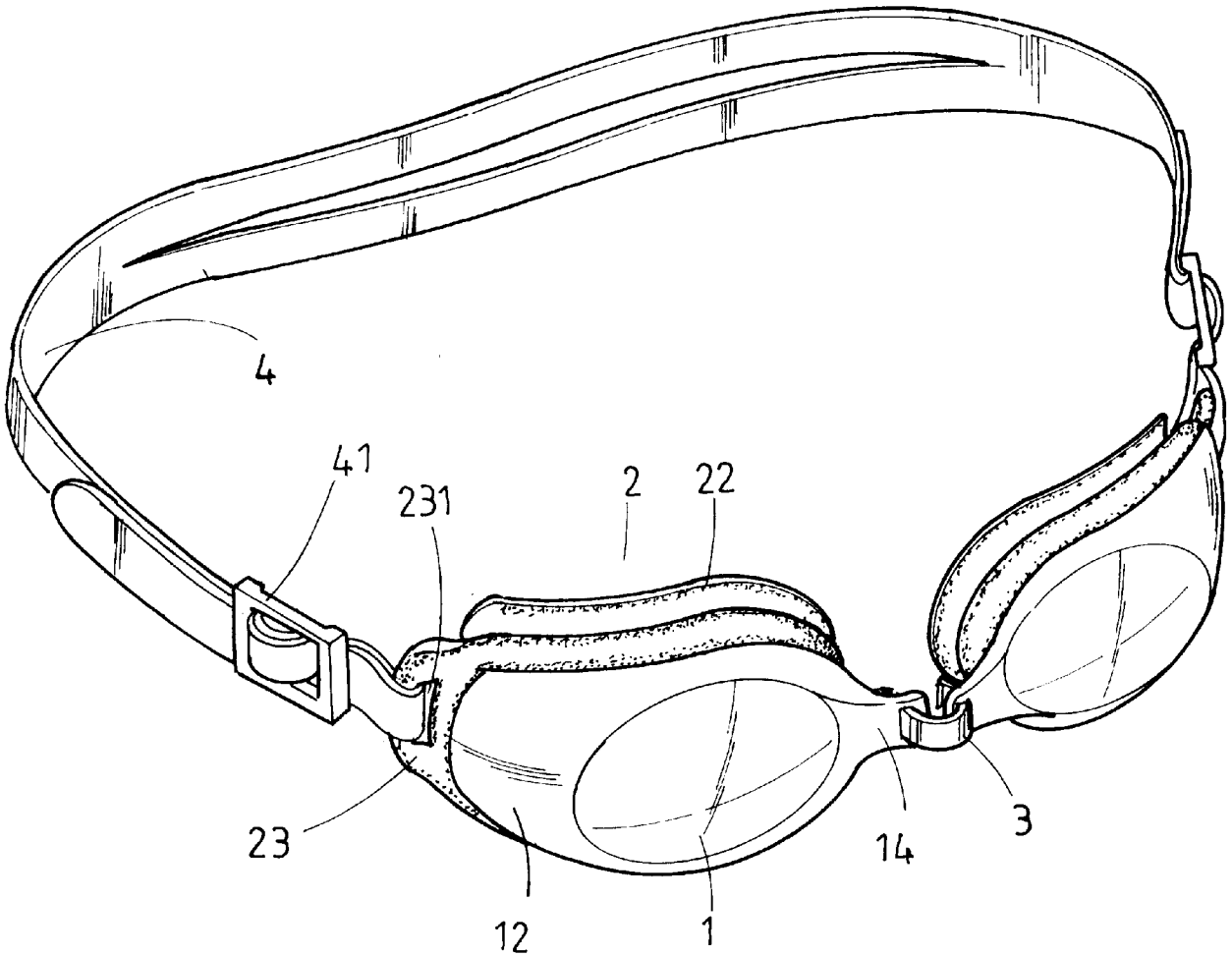
FIG. 2 is a perspective view of the pair of swimming goggles in accordance with the present invention.
Figure 4:
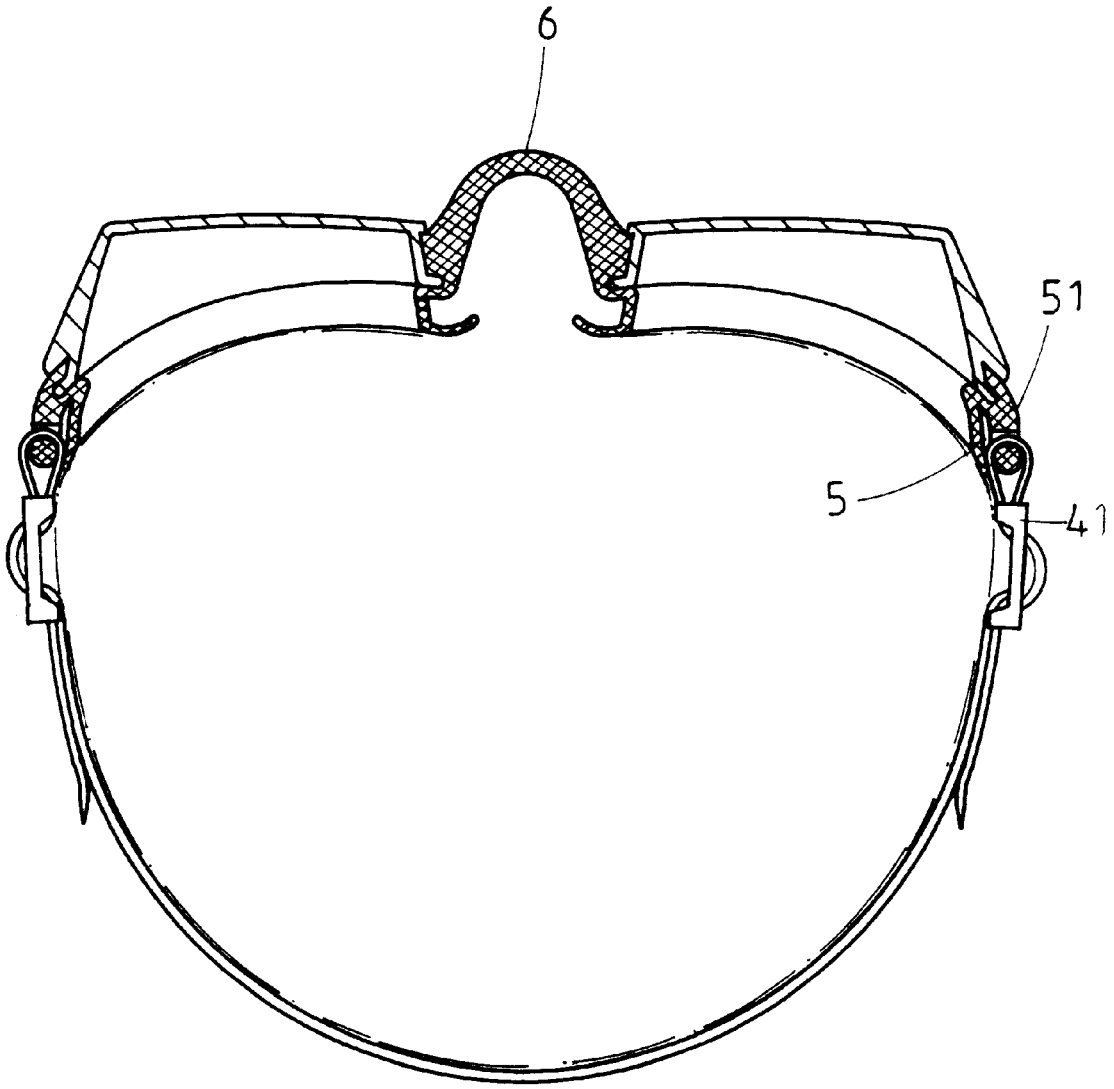
FIG. 4 is a sectional view illustrating a modified embodiment of the present invention.
Figure 5:
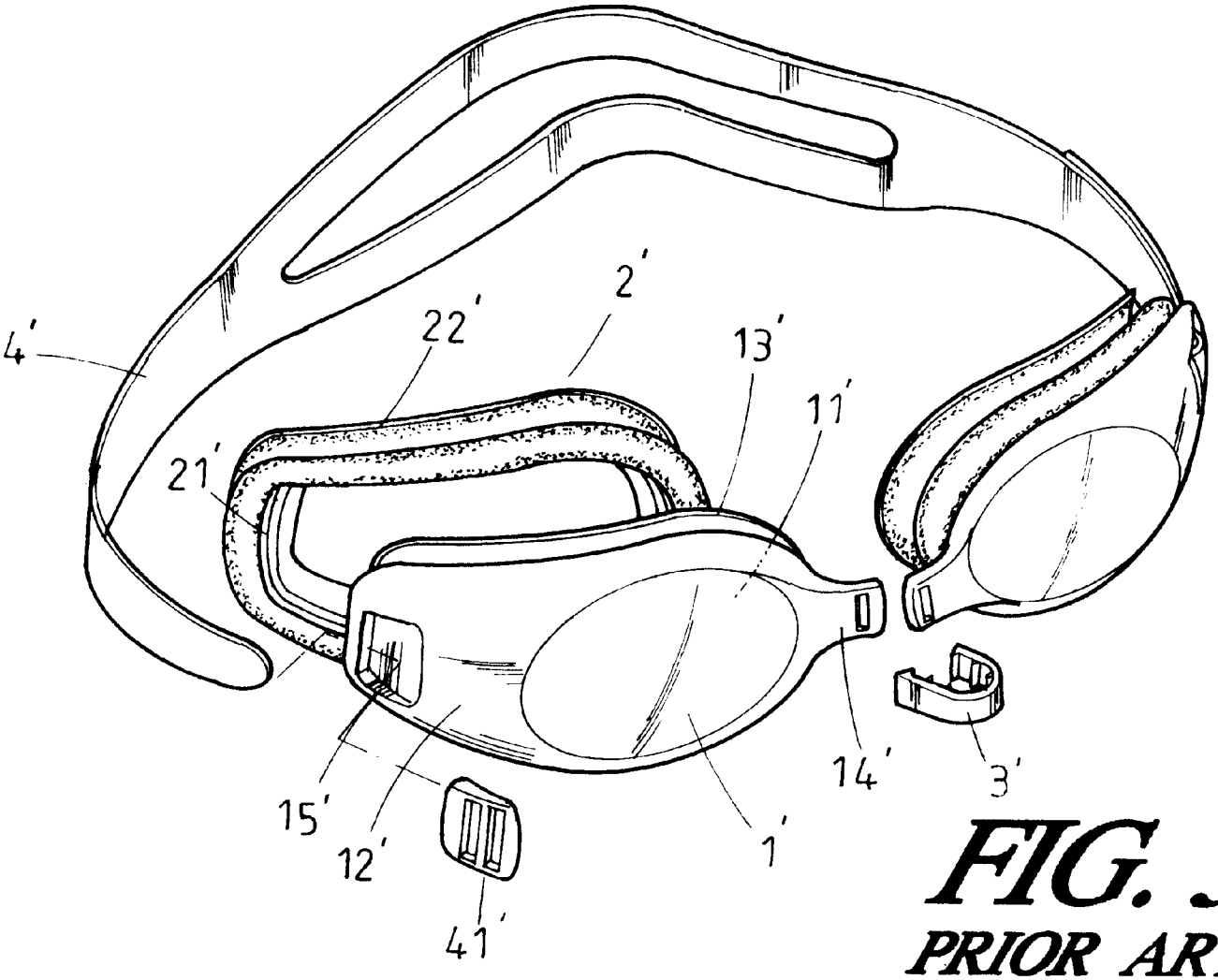
FIG. 5 PRIOR ART
FIG. 5 is an exploded view of a pair of swimming goggles according to prior art.
Figure 6:
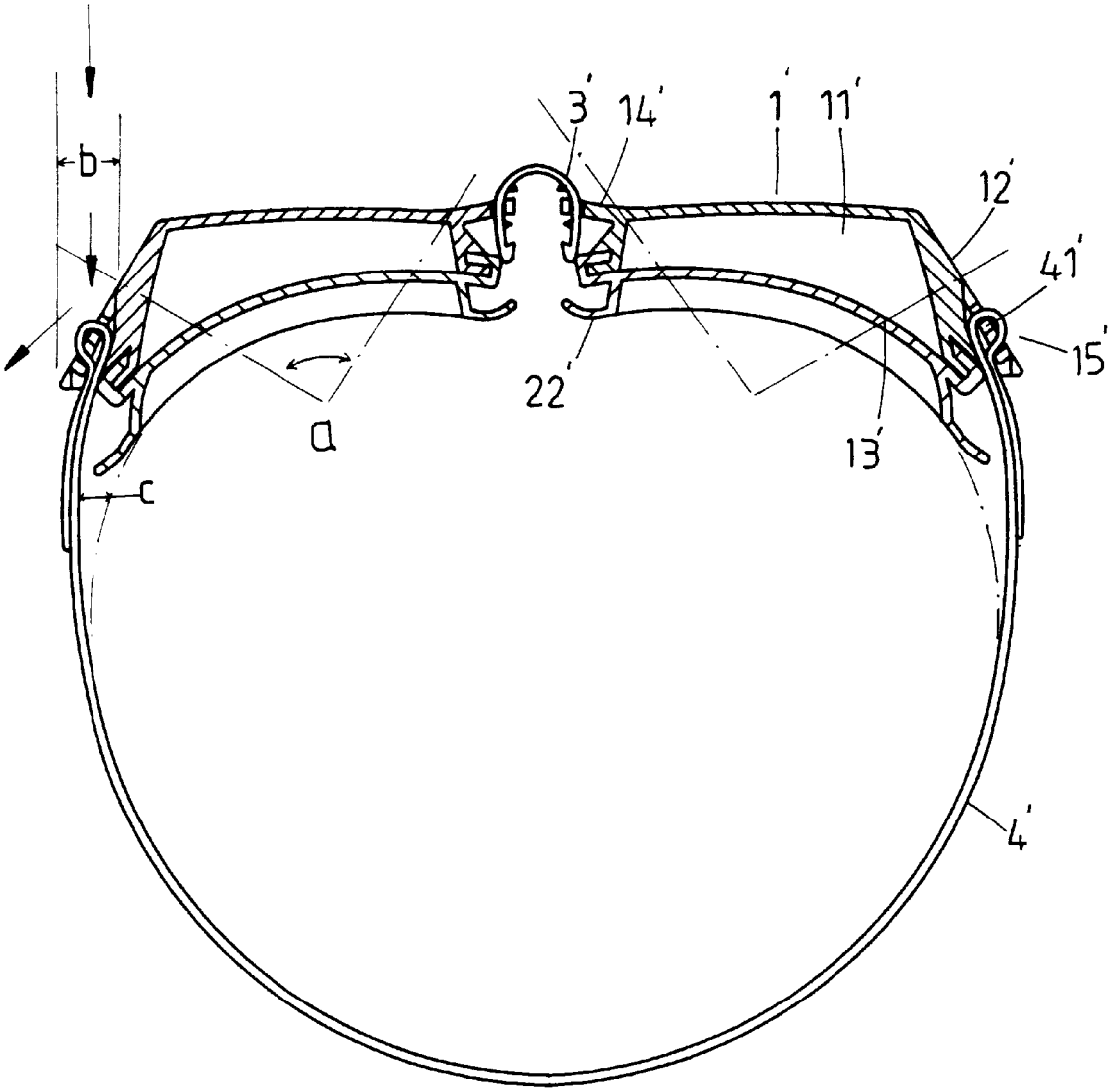
FIG. 6 PRIOR ART
FIG. 6 is a sectional view of the pair of swimming goggles according to prior art.

Referring to FIGS. 1 and 4 and initially to FIGS. 1 and 2, the present invention provides a pair of swimming goggles that includes two lenses 1, two pads 2, a bridge 3, and a strap 4. Each lens 1 is made of rigid transparent material and includes a recessed section 11 for receiving an eye portion of the user. Each lens 1 further includes an inner end 14 and a streamlined outer end 12. The inner ends 14 of the lenses 1' are connected by the bridge 3. Each lens 1 further includes a flange 13 formed on an inner side thereof.

Each pad 2 is substantially ring-like and made of plastic material. Each pad 2 includes a receiving section 21 for receiving an associated flange 13 and a contact section 22 to provide a close, comfortable contact with the user's eye socket. Each pad 2 further includes an outer end 23 with an opening 231 through which an end of the strap 4 is wound. A clamper 41 may be provided to allow length adjustment of the strap 4.

Figure 3:
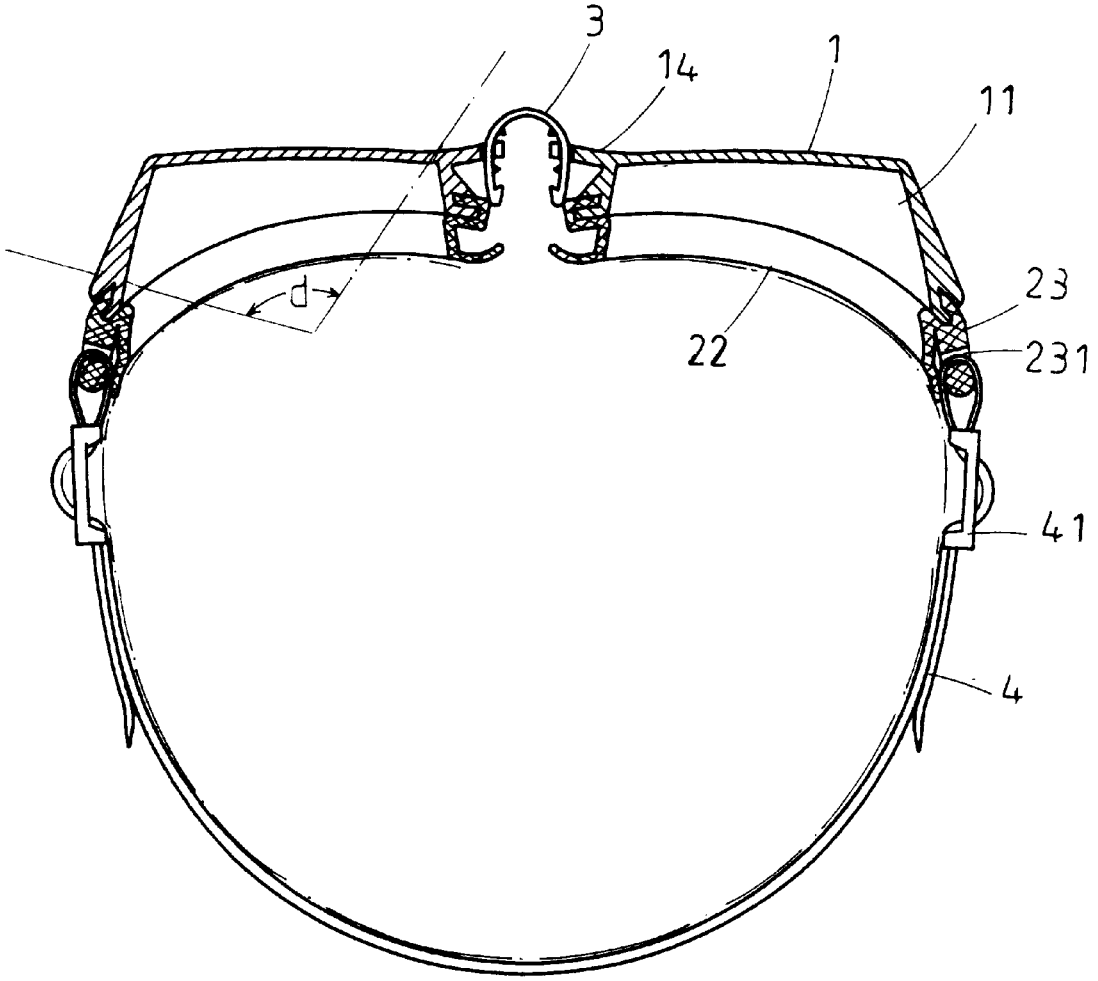
FIG. 3 is a sectional view of the pair of swimming goggles in accordance with the present invention.

In use, as shown in FIG. 3, the strap 4 is engaged with the pads 2 that may bend responsive to the outline of the user's head. Thus, the strap 4 is in a close, comfortable contact with the user's head and thus provides a reliable wearing of the swimming goggles. In addition, the visual angle "d" is larger than that in the conventional design, as the streamlined outer ends 12 of the lenses 1 of the present invention do not have the strap engaging sections. Further, the curvature of the streamlined outer end 12 may reduce the swimming resistance.

FIG. 4 of the drawings illustrates a modified embodiment of the present invention, in which the bridge (now designated by "6") is integrally formed with the pads (now designated by "5"). Again, each pad 5 includes a strap engaging section 51 to engage with the strap 4 to provide the same functions.

According to the above description, it is appreciated that a pair of swimming goggles in accordance with the present invention may have a close, comfortable contact with the user's head and thus provides a reliable wearing. In addition, the outer ends of the lenses are also transparent to provide a larger visual angle and increased safety for swimming. Furthermore, the outer ends of the lenses are streamlined to reduce the swimming resistance.

Although the invention has been explained in relation to its preferred embodiment, it is to be understood that many other possible modifications and variations can be made without departing from the spirit and scope of the invention as hereinafter claimed,

What is claimed is:

1. A pair of swimming goggles, comprising two lenses made of rigid transparent material and each including a recessed section adapted to receive an eye portion of a user, each said lens further including an inner end, a streamlined outer end, and a flange formed on an inner side thereof, a bridge for interconnecting the inner ends of the lenses, a strap having two ends, and two substantially ring-like pads made of waterproof material, each said pad including a receiving section for receiving an associated said flange and a contact section adapted to provide a close, comfortable contact with the user's eye socket, each said pad further including an outer end with an opening through which one of the ends of the strap is wound, with said outer end having a peripheral edge and with said opening disposed proximate to said peripheral edge.

* * * * *